US005342108A

United States Patent [19]

Housekeeper

[11] Patent Number: 5,342,108

[45] Date of Patent: Aug. 30, 1994

[54] CONVERTIBLE TABLE

[76] Inventor: John Housekeeper, 855 Gettysburg Dr., Lansdale, Pa. 19446

[21] Appl. No.: 101,647

[22] Filed: Aug. 4, 1993

[51] Int. Cl.[5] ..... A47B 85/04

[52] U.S. Cl. ..... 297/125; 297/128; 297/138; 297/143

[58] Field of Search ..... 297/124, 125, 128, 134, 297/136, 138, 143, 153, 154

[56] References Cited

U.S. PATENT DOCUMENTS 2,588,754 3/1952 Novi ..... 297/136

*Primary Examiner*—John T. Kwon

*Attorney, Agent, or Firm*—Caesar, Rivise, Bernstein, Cohen & Pokotilow, Ltd.

[57] ABSTRACT

A convertible table with a separable child-supporting chair releasably located within a recess in the top panel of the table. The chair is arranged to be stowed in a first orientation within the recess in the table in such a manner that the recess in the table's top panel is closed, with a portion of the chair being flush with the top surface of the top panel, thereby providing a smooth table top surface. The chair is slidable out of the recess so that it can be reoriented to a second orientation and then slid back into the recess so that it can support a child thereon adjacent the top panel. A locking mechanism is provided to prevent the chair from accidentally sliding out of the recess when it is in the second orientation. A restraining strap is provided in the chair.

13 Claims, 3 Drawing Sheets

CONVERTIBLE TABLE

FIELD OF THE INVENTION

This invention relates generally to the field of table devices and more particularly to tables that convert into child seats.

BACKGROUND OF THE INVENTION

Use of tables, or portions of tables, that convert into child seats have been known for a long time. The following constitute examples of various types of convertible tables found in the following U.S. Pat. Nos.: 4,511,177 (O'Sullivan); 2,605,816 (Vuori); 2,961,034 (Huffaker); 2,554,914 (Luckman); 2,746,524 (Brand et. al.); 2,655,202 (Gottfried); 2,871,920 (Nichols et. al); 2,540,291 (Reingold).

The table top/chair device disclosed by Vuori is a device having a portion of the table top that is cut from the top of the table and that can pivot downward about an axis that is along the table edge, thereby leaving an equivalent-sized hole in the table top just inside of the table edge. The non-pivot edge of the table top portion is hinged to another separate surface which forms the bottom of the child seat. One side of the surface forming the seat is secured to the underneath surface of the table by way of a flexible strap. The unrestrained weight of the hinged surfaces causes the child chair to form as follows: the cut-out table top portion comes to rest in a position that is perpendicular to the table top surface, forming the back of the chair while the other hinged surface comes to rest in a position parallel to the table top surface, forming the seat portion. Upward pressure on the hinge causes the seat to fold upwards and aligns the back of the seat with the table top while bringing the seat portion in close proximity to the underside of the table top. A spring-operated lock is used to lock the surfaces in place in the table top. Releasing the spring causes the surfaces to fall, thereby forming the child seat.

The table top/child seat disclosed by O'Sullivan utilizes a slidable leaf cut from the top of the table. A cable mechanism is attached to the bottom of the slideable leaf and the underside of the table top. A canvas having passageways along its edging (to house the cable) is fixed to the underside of the table, directly under the hole left by the slideable leaf when it is slid away from the table edge. Whenever the slideable leaf is pulled away from the table top, the cable mechanism causes the canvas to drop away from the underside of the table top, thereby forming a seat for a child. Whenever the slideable leaf is pushed back into the table top, the cable mechanism draws up the canvas, thereby stowing the canvas in close proximity to the underside of the table top.

The table top/child seat disclosed by Huffaker utilizes a collapsible seat that is stowed under the table top by means of arm rests that also act as rails that slide along tracks located under the table top. The back surface and seat surface of the chair are hinged together such that as the collapsible seat is slid away from the table, the weight causes the back and seat surfaces to come out of serial alignment and to form the chair. The seat surface is connected to the rails by rotatable links to support the seat surface in a parallel orientation with the table top. Tilting the back surface outward from the table and pushing it towards the table collapses the back and seat surfaces into serial alignment and stows these surfaces under the table.

The table top/child seat disclosed by Luckman utilizes a specially formed table having a hole for receiving a separate rigid child seat. A shiftable panel member can be slid out of the table top to enlarge the hole through which the child seat can be secured. The non-integral child seat is secured inside the hole in the table by pins located in the periphery of the hole. After the child is placed in the child seat, this panel can then be pushed back towards the table center to decrease the table top opening, thereby securing the child in the seat. A foot rest assembly is pivotally attached to the sides of the child seat. If it is desired to stow the table itself with the child seat remaining in the table, the footrest can be collapsed such that it is in close proximity to the underside of the table.

The table top/child seat disclosed by Brand et al. utilizes a cut away portion of a table top edge and a separate standing child seat that can be securably attached within the hole left by the cut away portion when that portion is swung down and locked up against the underside of the table top. The cut away portion is hinged inside of the table top edge such that when the portion is lowered the free standing child seat can be inserted into the hole. The child seat armrests act as rails that securely fit into guidance flanges along the periphery of the hole left by the cut away portion.

The table top/child seat disclosed by Gottfried has two embodiments of a baby tender device. The first embodiment consists of a collapsible chair/footrest that is pivotally mounted within a frame. The frame has engagement rails that connect into the edge of a receiving table. The frame also has a leg that supports the frame when the frame is engaged into the table. Upon removal of the frame from the table, the leg can be pivoted up towards the frame in order to collapse the chair and footrest. The second embodiment has the feature of releasably connecting a free standing chair to the frame which is then engaged into the table as disclosed in the first embodiment. Because a free standing chair can be used, there is no need for a separate leg to support the chair and there is also no collapsing elements.

The table top/folding seat disclosed by Nichols is also intended for use by toddlers. The Nichols device also comprises a portion of the table top that is cut from the top of the table but pivots about an axis parallel to the edge of the table and formed by slotted brackets attached to the underside of the table top and a metal bar attached to the cut away portion whose ends are trapped in the brackets. The edge of the cut away portion that moves downward is hinged to a second surface that is mounted in another bracket such that this second surface sweeps through an arc of 180 degrees forming the seat portion of the chair while the cut away portion sweeps through an arc of approximately 90 degrees, thereby forming the back surface of the chair. Pivoting bars having notches at various locations along their respective lengths lock and support the chair in its extended condition. A removable foot rest panel is can be secured between two of the pivoting bars to add a footrest feature while also enhancing the rigidity of the seat.

The table top/folding seat disclosed by Rheingold is also intended for use by toddlers. The cut away portion of the table top is mounted in a sliding pivot mechanism such that when the device is unlocked the weight of the collapsible chair will cause the cut away portion to rotate downward forming the back of the chair. A second surface, hinged to the cut away portion at one end and hinged to a stirrup frame at the other, moves downward forming the seat portion of the chair. A footrest is provided in the stirrup frame that also acts as the locking device when the seat is collapsed.

While the aforementioned patents appear generally suitable for their intended purposes, they suffer from one or more of the following drawbacks: complexity, ruggedness and maintenance.

Thus, a need exists for a chair that does not require a collapsing and/or hinging mechanism but rather is an integral part of a table, with the chair in an already erect state, such that when not in use some aspect of the chair restores the table top surface while stowing the chair portion.

OBJECTS OF THE INVENTION

Accordingly, it is the general object of this invention to provide an apparatus and a method of use which addresses the aforementioned needs.

It is a further object of this invention to provide an a convertible table that provides a child seat at the edge of the table.

It is a yet another object of this invention to provide a convertible table that does not require any collapsing or hinging mechanisms in order to restore the table top surface.

It is still another object of this invention to provide a child seat that is an integral part of the table itself, thereby not requiring the introduction of an external seat device.

It is yet a further object of this invention to provide a seat element that is already in its erect state regardless if the seat is being used or stowed in the table.

SUMMARY OF THE INVENTION

These and other objects of the instant invention are achieved by providing a convertible table comprising top panel having a planar top surface and a recess therein, removable seat means, and coupling means. The removable seat means comprises a first support member and a second support member fixedly secured to the first support member, with the first support member having a seat surface. The second support member has a front surface and a planar rear surface.

The seat means is arranged for selective positioning in first and second orientations within the recess. The coupling means is provided for slidably mounting the seat means within the recess in the first orientation, whereupon the planar rear surface of the seat means faces upward and is flush with the planar top surface of the top panel. The coupling means is releasable for enabling the seat means to be slid out of the recess, rotated to the second orientation and slidably mounted within the recess in the second orientation, whereupon the seat surface is located below the top panel but facing upward to support the buttocks of a child, and with the front surface of the second support member being directed at an angle to the seat surface to form a support for the back of the child.

DESCRIPTION OF THE DRAWINGS

Other objects and many of the attendant advantages of this invention will be readily appreciated as the same becomes better understood by reference to the following detailed description when considered in connection with the accompanying drawings wherein.

DESCRIPTION OF THE PREFERRED EMBODIMENT OF THE INVENTION

Figure 1:
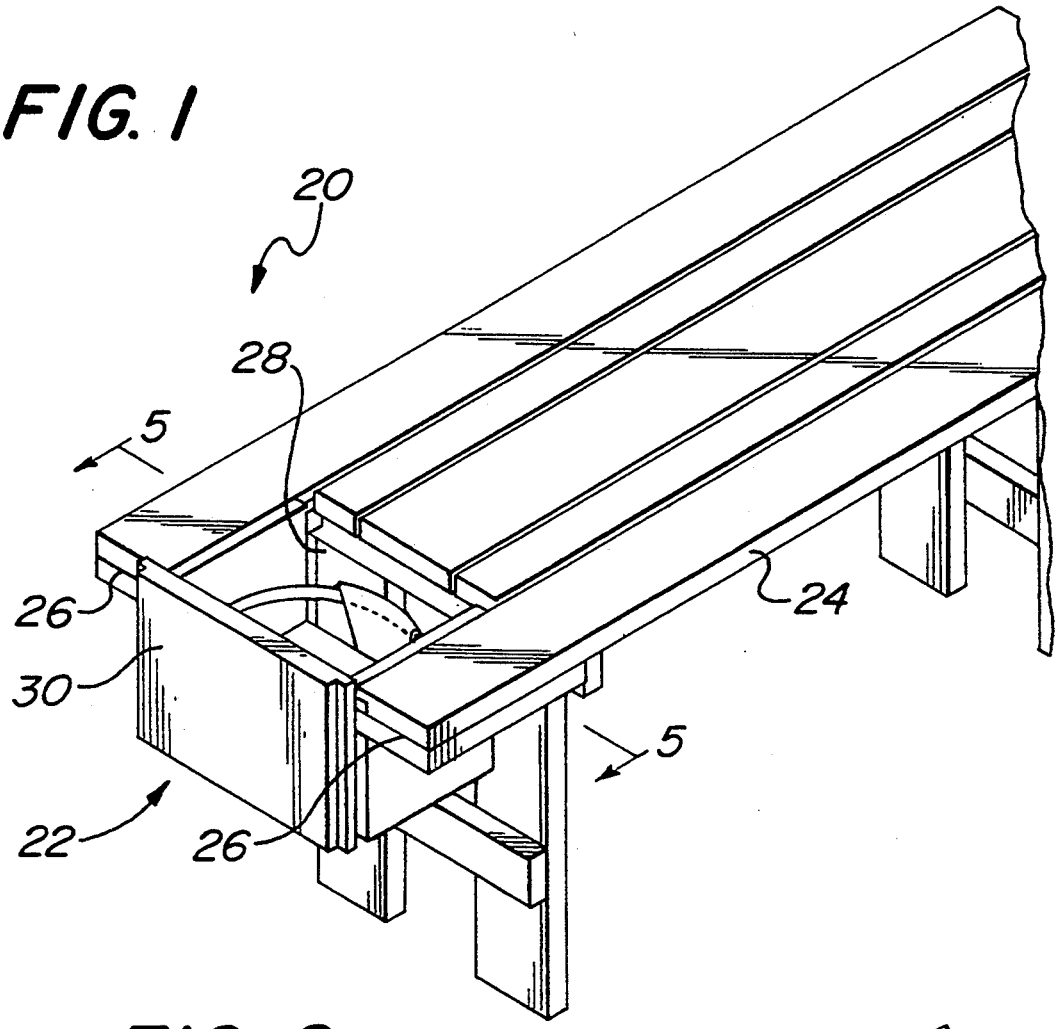
FIG. 1 is an isometric view of a portion of the table of this invention shown with its child seat oriented to support a child therein.

Referring now in greater detail to the various figures of the drawing wherein like reference characters refer to like parts, a convertible table having a separable child seat or chair constructed in accordance with the present invention is shown generally at 20 in FIG. 1.

Figure 4:
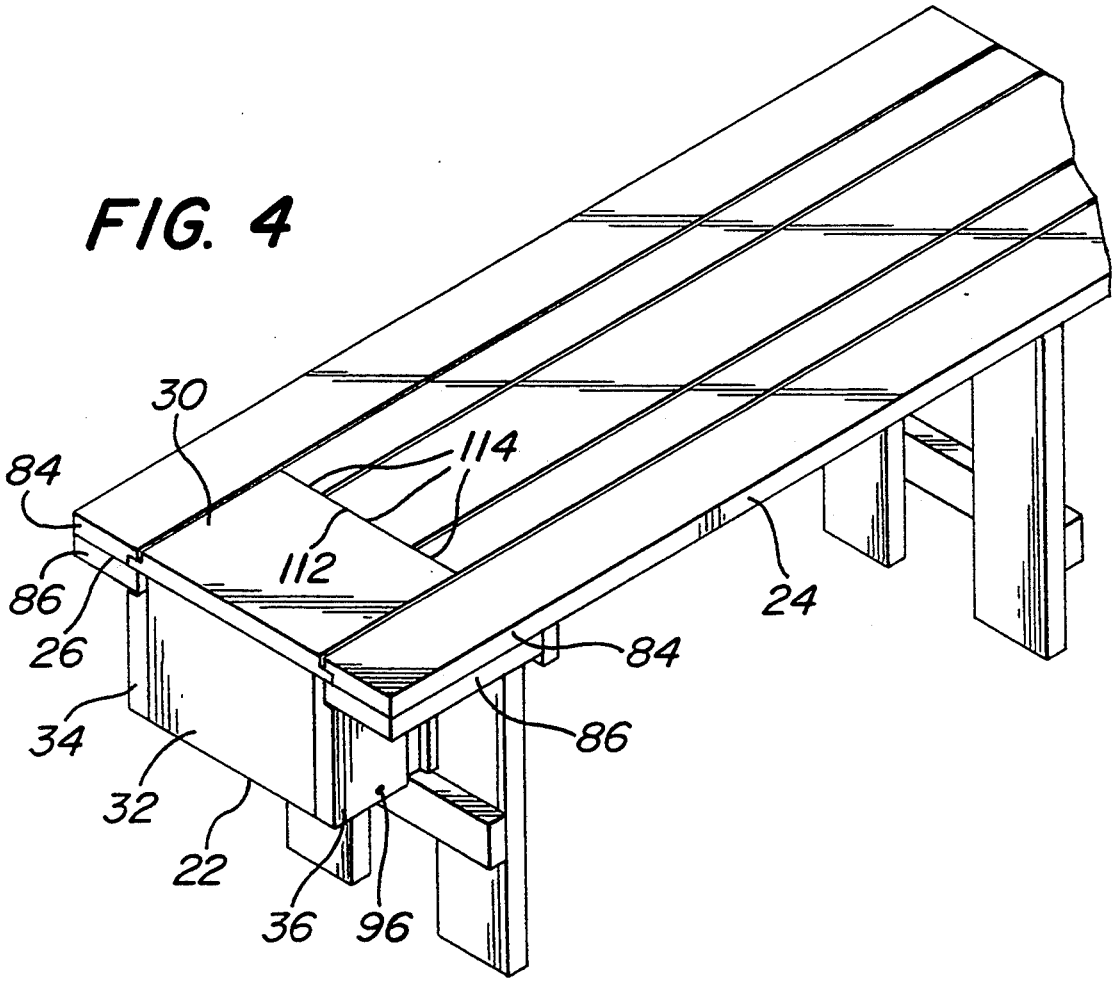
FIG. 4 is an isometric view similar to FIG. 1 but showing the child seat of the convertible table in its stowed position.

The convertible table 20 comprises a separable child seat or chair 22 and a table top 24. The table includes plural legs to support it. At one end 26 of table top 24 there is a cut-out portion or recess 28 which provides the space for releasably holding the separable child seat 22 therein. The separable child seat 22 can be oriented so that it forms a chair at the edge of the table to support a child therein adjacent the table top as shown in FIG. 1 or can be oriented 90° so that it can be stowed within the recess as shown in FIG. 4 with a portion of it serving as part of the table top 24.

Figure 2:
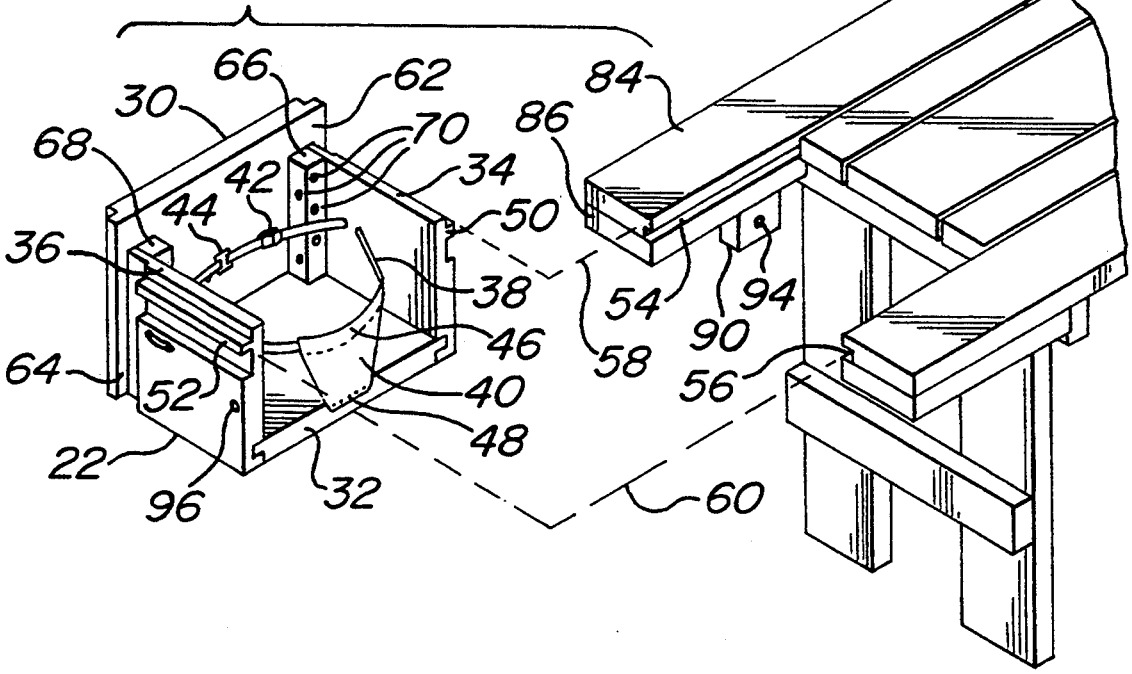
FIG. 2 is an exploded isometric view of the portion of the table shown in FIG. 1 with the child seat oriented in the orientation to support a child therein.
Figure 5:
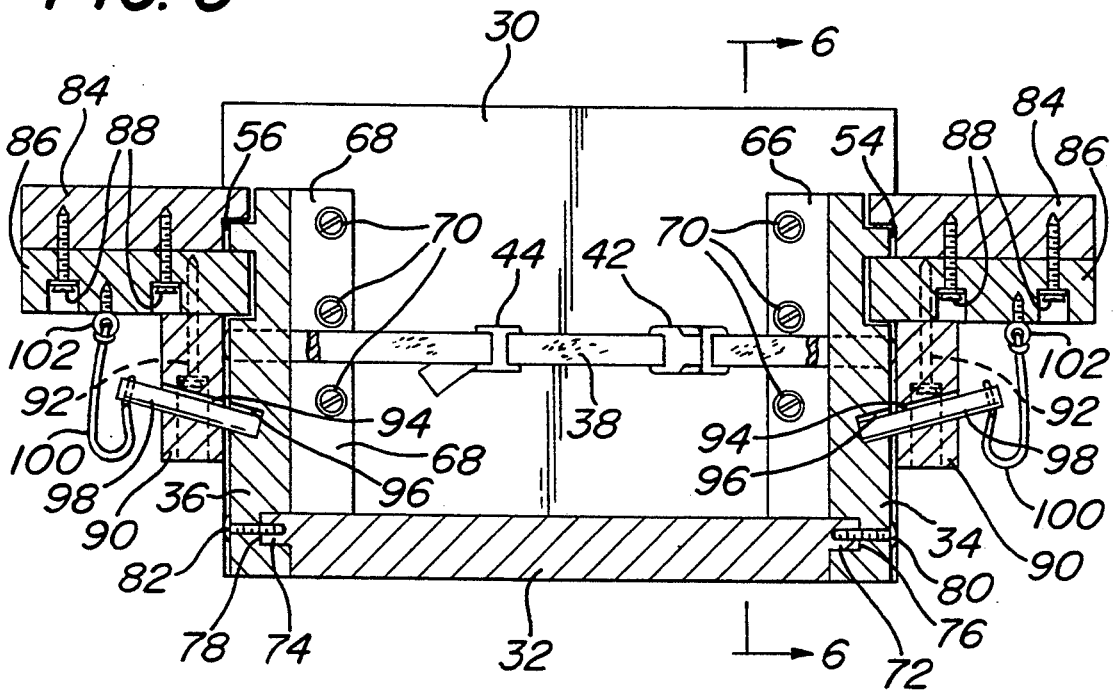
FIG. 5 is an enlarged sectional view taken along line 5—5 of FIG. 1.
Figure 6:
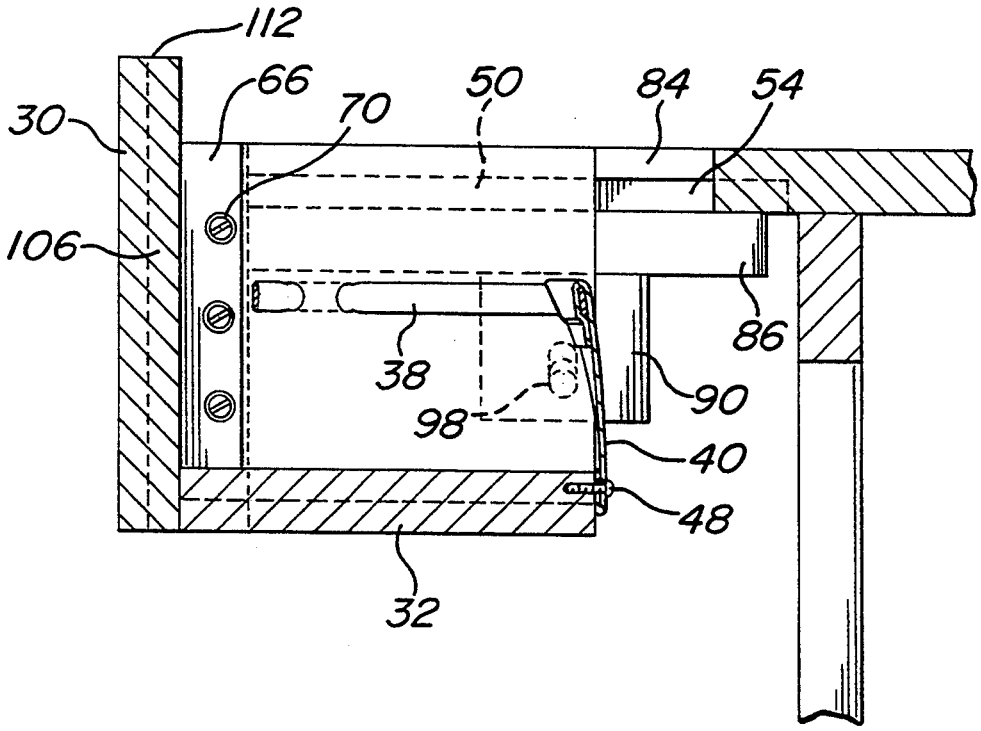
FIG. 6 is a sectional view taken along line 6—6 of FIG. 5.

The seat function of the convertible table will be discussed first. Thus, as can be seen in FIGS. 2, 5 and 6 the separable seat 22 comprises a back panel 30, a seat panel 32, a left side panel 34 and a right side panel 36. A restraining harness 38 and expanded leg separator 40 span the seating to secure a child (not shown) in the seat. The restraining harness 38 is held in the left panel 34 and the right panel 36 by holes provided in the respective panels. A child resistant lock buckle 42 locks the child into the seat 22 while a size adjustment clip 44 provides a means to tighten or loosen the restraining harness 38 around the child. The upper end of the leg separator 40 is secured to the restraining harness 38 by a stitched fabric lip 46, while the lower end of the leg divider is secured to the seat panel 32 by screws 48 (e.g., grommetted screws).

The child seat is arranged to be supported in the recess in either its child-supporting orientation (shown in FIG. 1) or in its stowed orientation (shown in FIG. 4) by releasably securable coupling means. That means comprises cooperating ridges and grooves to be discussed hereinafter. In particular, each side panel, 34 and 36, has a protruding ridge 50 and 52, respectively, that runs across the width of each side panel. Each protruding ridge, 50 and 52, fits into a corresponding receiving channel or groove 54 and 56, respectively, in the table 24, within the periphery of recess 28. Alignment of each protruding ridge and its corresponding receiving channel is indicated in FIG. 2 by the broken lines 58 and 60. Once the protruding ridges 50 and 52 are engaged in their respective receiving channels 54 and 56, the chair 22 can be slid or pushed into the recess 28 until the peripheral surfaces 62 and 64 of the back panel 30 contact the table edge 26, as shown in FIG. 1.

A pair of seat back assembly cleats 66 and 68 secure the side panel 34 and side panel 36 to the back panel 30 by the use of countersunk screws 70. As can be seen more easily in FIG. 5, the seat panel 32 is secured to the side panels 34 and 36 by use of notches 72 and 74, respectively, engaging respective receiving slots 76 and 78. The seat panel 32 is further locked in place by screws 80 and 82.

As shown clearly in FIG. 5, receiving channels 54 and 56 are formed by a table top plank 84 and a glide rail plank 86 fastened together by countersunk screws 88. A notch cut along the lower edge of the table top plank 84 forms the major portion of each receiving channel 54 and 56.

Means for locking the chair in the child supporting orientation of FIGS. 1 and 2 is provided in the form of a pair of lock blocks 90. Each lock block 90 is fastened to its associated glide rail plank 86 by countersunk screws 92. As can be seen in FIG. 2, each lock block 90 has a hole 94 which is oriented at a downward angle. Each side panel, 34 and 36 of the child seat 22 has a matching hole 96 that is also downwardly pitched such that when the seat's protruding ridges 50 and 52 are engaged in the respective receiving channels, 54 and 56, and the seat is pushed in until the peripheral surfaces 62 and 64 contact the table edge 26, the holes 94 and 96 are aligned. A locking pin 98 is provided on each side of the seat. Each pin 98 is arranged to be inserted down through its associated hole 94 and into the aligned hole 96. The downward orientation of the pin 98 in the aligned holes 94 and 96 locks the seat 22 in place, thereby preventing the child from being able to inadvertently slide the seat 22 back away from the table 24. Each locking pin 98 is attached to a respective glide rail plank 86 by way of a flexible tether 100 which is itself tied to an eyebolt 102. It should be pointed out that the use of two lock blocks and pins is not required. Thus, for some applications only one lock block and pin may be used. In fact, it is contemplated that the weight of the child within the seat may obviate the need for any locking means.

Figure 3:
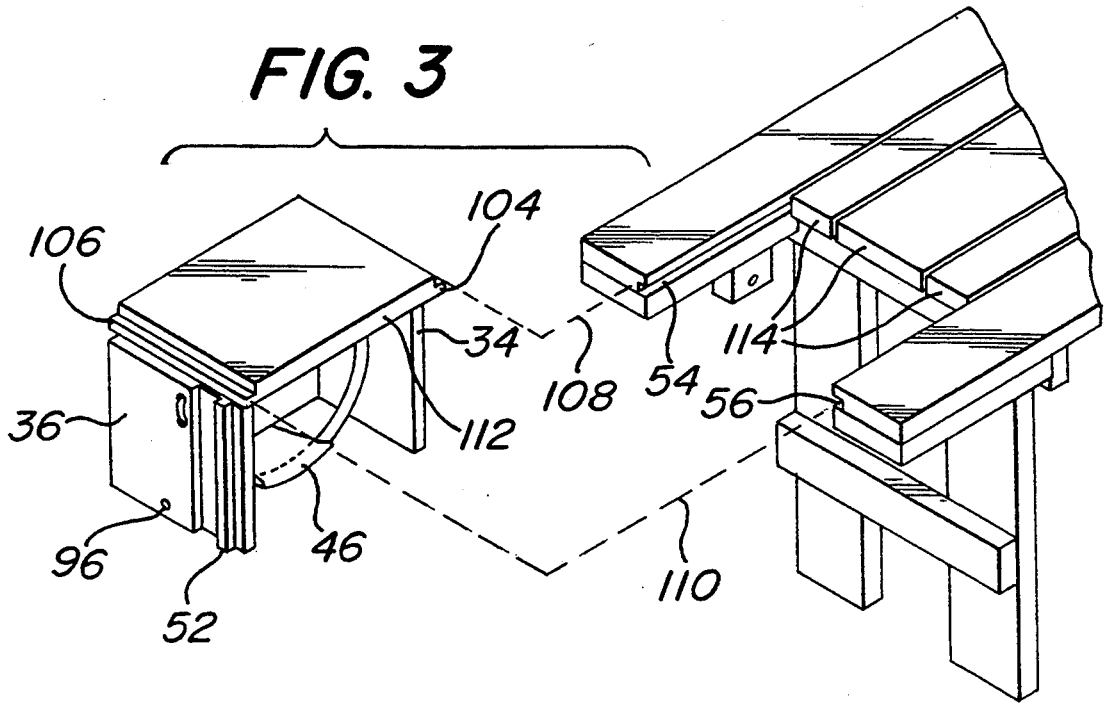
FIG. 3 is an exploded isometric view similar to FIG. 2 but showing the child seat oriented so that it is easy to be stowed.

When the seat 22 is no longer to be used, it can be removed and oriented to the position shown in FIG. 3 and then reinserted within the recess 28 to close the table top. In this regard each locking pin 98 is simply removed from the holes 96 and 94 and released. Each locking pin 98 remains attached to the glide rail plank 86 by the tether 100 and the eyebolt 102.

When the child seat 22 is to be stowed so as to act as part of the table top 24, the seat 22 is slid totally out of the recess 28. The chair 22 is then rotated 90° to the orientation shown in FIG. 3 so that the back panel 30 is parallel to the table top 24, as shown therein. As can be seen in FIGS. 3 and 6 the sides of the back panel 30 comprise elongated protruding ridges, 104 and 106, respectively. The protruding ridges 104 and 106 are identical to the protruding ridges 50 and 52, discussed earlier and are arranged to be received within the receiving channels 54 and 56, respectively to stow the child seat 22. In particular, once the protruding ridges 104 and 106 are engaged in their respective receiving channels 54 and 56, the chair 22 can be pushed (slid) into the recess 28 until the top edge 112 of the back panel 30 contacts the table top planks 114, as shown in FIG. 4. Thus, the table top 24 is now complete and can be used for regular purposes.

It should be noted that the convertible table 20 of this invention can be formed of any materials, such as wood, plastic, metal or combinations thereof.

Without further elaboration, the foregoing will so fully illustrate my invention that others may, by applying current or future knowledge, readily adopt the same for use under various conditions of service.

I claim:

1. A convertible table comprising:

(a) top panel having a planar top surface and a recess therein;

(b) removable seat means comprising a first support member and a second support member fixedly secured to said first support member, said first support member having a seat surface, said second support member having a front surface and a planar rear surface, said seat means being arranged for selective positioning in first and second orientations within said recess; and (c) coupling means for slidably mounting said seat means within said recess in said first orientation, whereupon said planar rear surface of said seat means faces upward and is flush with said planar top surface of said top panel, said coupling means being releasable for enabling said seat means to be slid out of said recess, rotated to said second orientation and slidably mounted within said recess in said second orientation, whereupon said seat surface is located below said top panel but facing upward to support the buttocks of a child, and with said front surface of said second support member being directed at an angle to said seat surface to form a support for the back of said child.

2. The convertible table of claim 1 wherein said second member is of a shape corresponding to the shape of said recess, whereupon when said seat means is in said first orientation said second member substantially closes off said recess.

3. The convertible table of claim 1 wherein said coupling means comprises a pair of protruding ridges and a pair of corresponding grooves.

4. The convertible table of claim 3 wherein said pair of protruding ridges form a portion of said seat means, and wherein said pair of corresponding grooves form edge portions of said recess.

5. The convertible table of claim 1 wherein said seat means additionally comprises a pair of side members fixedly secured to said first and second support members on opposite sides thereof, and wherein said coupling means forms a portion of said side members and a portion of said recess.

6. The convertible table of claim 3 wherein said seating means additionally comprises a pair of side members fixedly secured to said first and second support members on opposite sides thereof, and wherein said pair of protruding ridges form portions of respective ones of said side members.

7. The convertible table of claim 1 additionally comprising locking means to lock said seat means in said second orientation within said recess.

8. The convertible table of claim 7 wherein said seating means additionally comprises a pair of side members fixedly secured to said first and second support members on opposite sides thereof, with said locking means being coupled to at least one of said side members.

9. The convertible table of claim 8 wherein at least one of said side members has a hole therein, and wherein said locking means comprises at least one lock block and a locking pin, said top panel having an underside, said lock block being affixed to said underside of said top panel closely adjacent said recess, said lock block having a hole to receive said locking pin, with a portion of said locking pin extending into the hole in said at least one side member.

10. The convertible table of claim 9 wherein said locking pin is tethered at one end to the underside of said top panel.

11. The convertible table of claim 1 wherein said seat means additionally comprises an adjustable restraining strap.

12. The convertible table of claim 11 wherein said seating means additionally comprises a pair of side members fixedly secured to said first and second support members on opposite sides thereof and wherein said adjustable restraining strap is connected between said side members.

13. The convertible table of claim 12 additionally comprising a leg separator is secured between said adjustable restraining strap and said first support member.

* * * * *